US010367293B1

(12) United States Patent
Ono

(10) Patent No.: US 10,367,293 B1
(45) Date of Patent: Jul. 30, 2019

(54) ELECTRICAL CONNECTOR

(71) Applicant: SMK Corporation, Tokyo (JP)

(72) Inventor: Naoyuki Ono, Chiba (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/114,226

(22) Filed: Aug. 28, 2018

(30) Foreign Application Priority Data

Feb. 6, 2018 (JP) ..... 2018-018859

(51) Int. Cl.

| | |
|---|---|
| ***H01R 13/52*** | (2006.01) |
| ***H01R 12/72*** | (2011.01) |
| ***H01R 13/6582*** | (2011.01) |
| *H01R 24/62* | (2011.01) |
| *H01R 107/00* | (2006.01) |

(52) U.S. Cl.
CPC ..... *H01R 13/5202* (2013.01); *H01R 12/724* (2013.01); *H01R 13/6582* (2013.01); *H01R 24/62* (2013.01); *H01R 2107/00* (2013.01)

(58) Field of Classification Search
CPC ..... H01R 13/5202
See application file for complete search history.

(56) References Cited

U.S. PATENT DOCUMENTS

| | | | | |
|---|---|---|---|---|
| 9,660,373 | B2 * | 5/2017 | Tsai | H01R 13/5202 |
| 9,711,910 | B2 * | 7/2017 | Zhao | H01R 13/6581 |
| 9,742,098 | B2 * | 8/2017 | Zhao | H01R 13/5202 |
| 9,761,988 | B1 * | 9/2017 | Lin | H01R 13/5216 |
| 9,793,644 | B2 * | 10/2017 | Fujii | H01R 13/6581 |
| 9,843,128 | B2 * | 12/2017 | Tsai | H01R 13/5202 |
| 9,853,393 | B2 * | 12/2017 | Guo | H01R 13/405 |
| 9,935,393 | B2 * | 4/2018 | Tada | H01R 12/724 |
| 9,960,522 | B2 * | 5/2018 | Tada | H01R 12/707 |
| 9,985,393 | B2 * | 5/2018 | Zhao | H01R 12/58 |
| 9,997,859 | B2 * | 6/2018 | Yu | H01R 4/2454 |
| 9,997,866 | B1 * | 6/2018 | Hsu | H01R 13/5202 |
| 10,074,927 | B1 * | 9/2018 | Ono | H01R 13/5202 |
| 10,074,930 | B2 * | 9/2018 | Zhu | H01R 13/5202 |
| 10,096,948 | B2 * | 10/2018 | Yu | H01R 13/6581 |
| 10,109,967 | B2 * | 10/2018 | Zhao | H01R 13/6586 |
| 10,141,679 | B2 * | 11/2018 | Ono | H01R 13/28 |
| 10,164,370 | B2 * | 12/2018 | Ono | H01R 13/521 |
| 10,177,485 | B2 * | 1/2019 | Ono | H01R 13/5202 |
| 10,177,488 | B2 * | 1/2019 | Zhao | H01R 13/5219 |
| 10,177,502 | B2 * | 1/2019 | Zhao | H01R 13/6471 |
| 2012/0315779 | A1 | 12/2012 | Yudate et al. | |

(Continued)

*Primary Examiner* — Ross N Gushi

(57) ABSTRACT

An electrical connector includes an insulating housing; a conductive contact held by the housing, the conductive contact including connection portions exposed on a front side of the housing to be connected to a mating contact of a mating connector and terminal portions protruding from the housing; a cylindrical shell configured to contain the housing, the cylindrical shell including a front shell member and a rear shell member, the front shell member having a fitting portion open forward into which the mating connector is insertable, the rear shell member being provided at the rear of the front shell member so as to protrude the terminal portions therefrom, the rear shell member having a smaller diameter than the front shell member; and an elastically deformable seal member configured to be provided on an outer periphery of the rear shell member.

6 Claims, 8 Drawing Sheets

(56) References Cited

U.S. PATENT DOCUMENTS

| | | | | |
|---|---|---|---|---|
| 2015/0244099 | A1* | 8/2015 | Lee | H01R 13/508 439/660 |
| 2016/0093974 | A1* | 3/2016 | Lai | H01R 13/5202 439/736 |
| 2018/0034195 | A1* | 2/2018 | Chang | H01R 13/5219 |
| 2018/0151978 | A1* | 5/2018 | Zhao | H01R 13/5208 |
| 2018/0159267 | A1* | 6/2018 | Zhao | H01R 13/6594 |
| 2018/0254587 | A1* | 9/2018 | Zhao | H01R 4/029 |
| 2018/0269617 | A1* | 9/2018 | Zhang | H01R 13/508 |
| 2018/0287290 | A1* | 10/2018 | Kifune | H01R 13/504 |
| 2018/0287291 | A1* | 10/2018 | Kifune | H01R 13/504 |
| 2018/0337488 | A1* | 11/2018 | Zhang | H01R 13/5202 |
| 2018/0366862 | A1* | 12/2018 | Zhao | H01R 13/6586 |
| 2018/0366879 | A1* | 12/2018 | Zhou | H01R 13/6581 |

* cited by examiner

ELECTRICAL CONNECTOR

CROSS REFERENCE TO RELATED APPLICATION

The contents of the following Japanese patent application are incorporated herein by reference, Japanese Patent Application No. 2018-018859 filed on Feb. 6, 2018.

FIELD

The present invention relates to an electrical connector having a watertight function.

BACKGROUND

Conventionally, electrical connectors attached to devices such as electronic devices have been required to have a watertight function in order to make the inside of the devices watertight from the outside. As such an electrical connector, there is known an electrical connector having a structure configured to prevent liquid from getting into the inside of the device through a gap between the connector and the device from outside when attached to the device.

Patent Literature 1 discloses an electrical connector having a watertight function. In the electrical connector, a shell 5 is fitted inside a casing 2. A seal member 6 is provided in the vicinity of an end portion of the casing 2 on a connection terminal insertion side around an outer periphery of the casing 2. In the electrical connector disclosed in Patent Literature 1, the seal member 6 is in press contact with a surface of a case for containing the casing 2 therein on the connection terminal insertion side, in order to prevent water from getting into a gap between the case and the casing 2.

CITATION LIST

Patent Literature

Patent Literature 1: Japanese Patent No. 5155492

SUMMARY

Technical Problem

However, Patent Literature 1 requires the casing to hold the seal member, and the seal member is provided on the outer periphery of the casing. Accordingly, an outer periphery of the electrical connector increases in size by the thicknesses of the casing and the seal member, and this hinders downsizing and slimming of the electrical connector. In Patent Literature 1, the seal member is provided in the vicinity of the end portion of the casing on the connection terminal insertion side. Thus, when the casing is installed in the case, the case may get snagged on a securing portion of a seal member provided on the casing. The seal member may be thereby damaged or displaced, and therefore cause deterioration in watertight function. Furthermore, in Patent Literature 1, to prevent upsizing of the electrical connector, the thickness of the seal member has to be reduced. Thus, the case has a reduced press contact capable area in which the seal member has an appropriate compressibility. When the electrical connector is installed in the case, the dimensions of the case are required to be managed with high accuracy, thus causing a reduction in productivity.

An object of the present invention is to provide an electrical connector that can prevent an installation member from getting snagged on a securing portion of a seal member provided on a shell, and can have improved productivity, as well as a reduced size and thickness.

Solution to Problem

An electrical connector according to an aspect of the present invention includes a holding member having an insulation property; a conductive contact held by the holding member, the conductive contact including a connection portion exposed on a front side of the holding member to be connected to a mating contact of a mating connector and a terminal portion protruding from the holding member; a shell configured to be cylindrical and contain the holding member, the cylindrical shell including a large diameter portion and a small diameter portion, the large diameter portion having a fitting portion open forward into which the mating connector is insertable, the small diameter portion being provided at the rear of the large diameter portion so as to protrude the terminal portion therefrom, the small diameter portion having a smaller diameter than the large diameter portion; and a seal member configured to be elastically deformable and be provided on an outer periphery of the small diameter portion.

When the electrical connector is inserted and installed into the installation member from its rear to its front, the large diameter portion is first inserted into the installation member, and subsequently the small diameter portion is inserted into the installation member. The seal member is in press contact with the installation member in a distance between the large diameter portion and the small diameter portion in a compressible state, so that the seal member blocks liquid from getting from outside into the installation member through a gap between the shell and the installation member.

According to the aspect of the present invention, the installation member is prevented from getting snagged on a securing portion of a seal member provided on the shell, and therefore the electrical connector can have improved productivity, as well as a reduced size and thickness.

DESCRIPTION OF EMBODIMENTS

Figure 1:
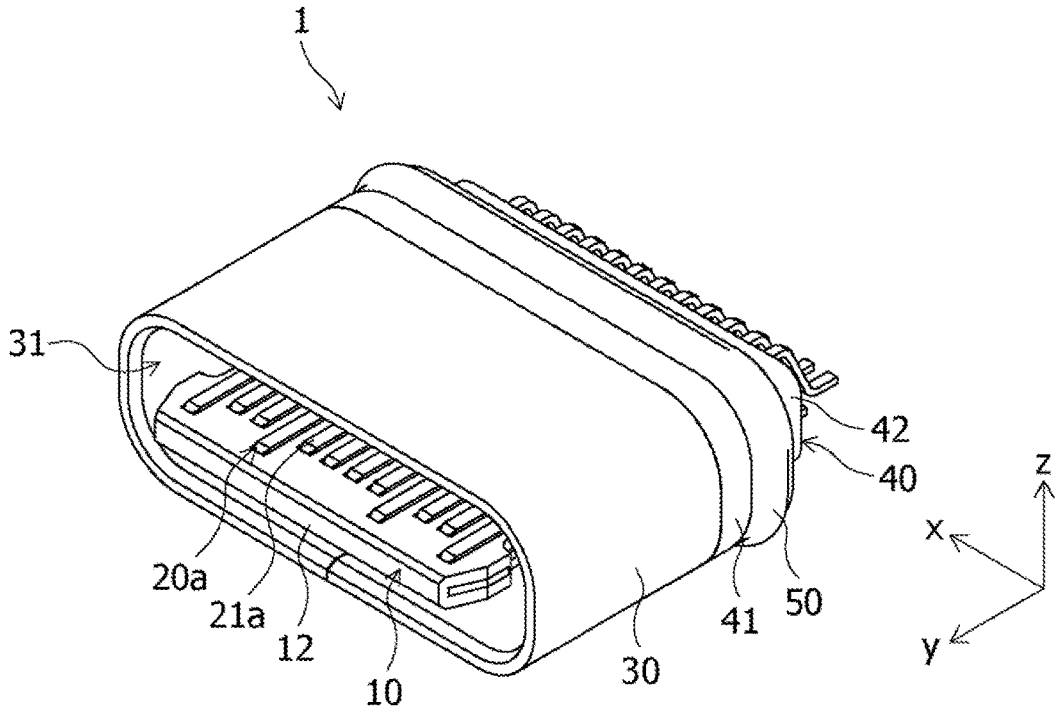
FIG. 1 is a perspective view of an electrical connector, viewed from the diagonally upper front, according to a first embodiment of the present invention.
Figure 2:
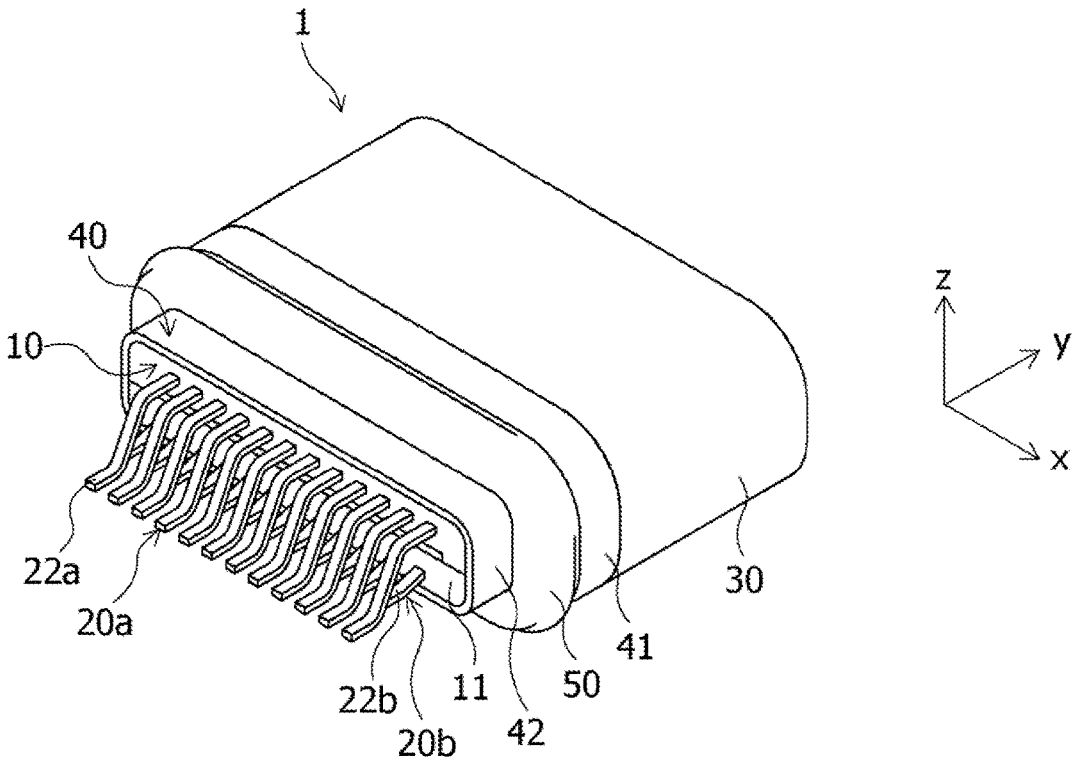
FIG. 2 is a perspective view of the electrical connector, viewed from the diagonally upper rear, according to the first embodiment of the present invention.

An electrical connector according to embodiment(s) of the present invention will be described below in detail with appropriate reference to the drawings. In the drawings, an x axis, a y axis, and a z axis constitute a three-axis orthogonal coordinate system. In the following description, a positive direction of the y-axis will be referred to as a front direction, a negative direction of the y-axis as a rear direction, the direction of the x-axis as a horizontal direction, a positive direction of the z-axis as an upward direction, and a negative direction of the z-axis as a downward direction.

First Embodiment

<Configuration of Electrical Connector>

A configuration of an electrical connector 1 according to a first embodiment of the present invention will be described below in detail with reference to FIGS. 1 to 8.

The electrical connector 1 according to this embodiment has a housing 10, contacts 20, a front shell member 30, a rear shell member 40, a seal member 50, and a shielding plate 60.

The housing 10, which is made of an insulating material, is a holding member for holding the contacts 20. The housing 10 contains a silane coupling agent in a portion that is in close contact with the contacts 20 along outer peripheral surfaces of the contacts 20. Since the silane coupling agent has a reaction group chemically bonding to an inorganic material and a reaction group chemically bonding to an organic material, the silane coupling agent has the property capable of bonding an organic material and an inorganic material.

The housing 10 has a main body portion 11 and a plate-like portion 12.

Figure 5:
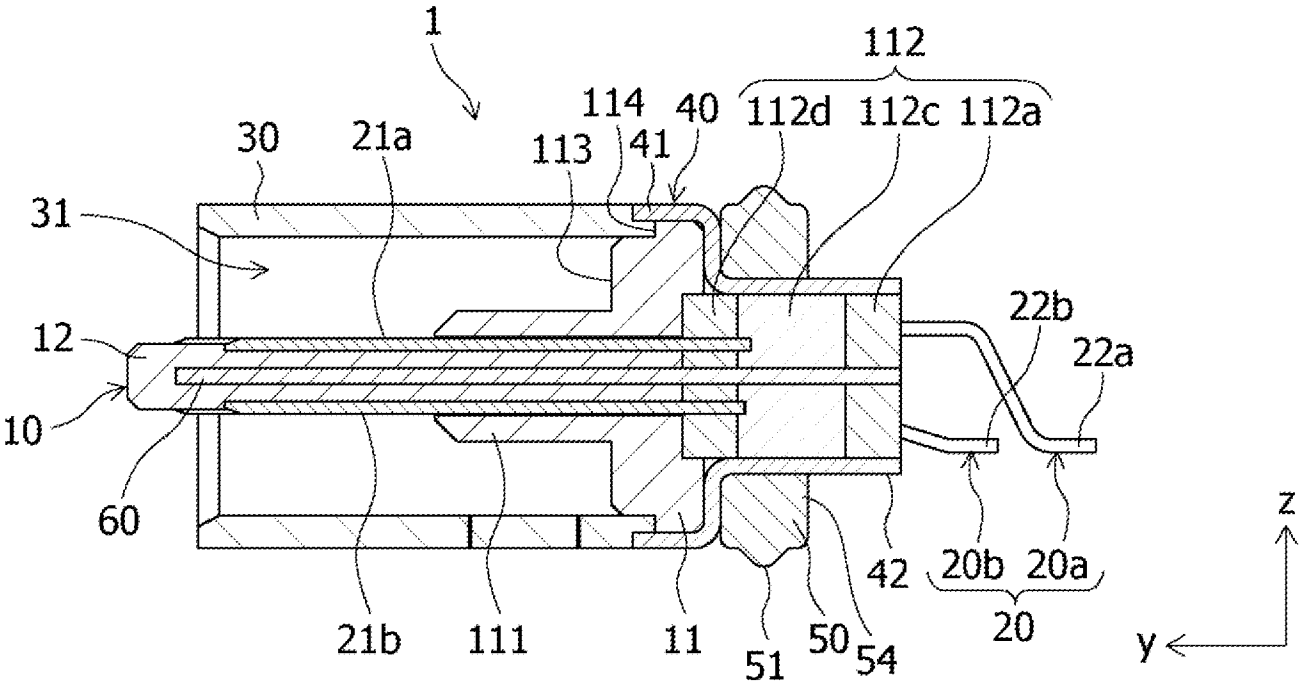
FIG. 5 is a cross-sectional view taken along A-A of FIG. 3.
Figure 6:
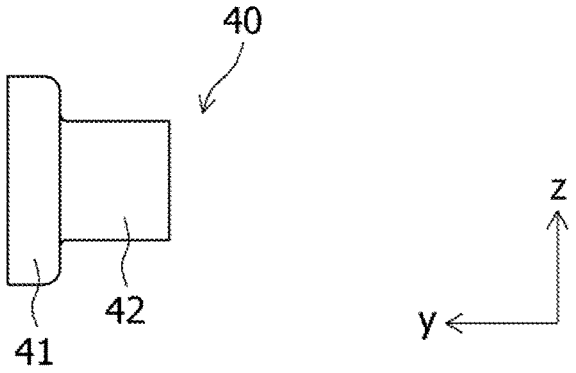
FIG. 6 is a side view of a rear shell member according to the first embodiment of the present invention.
Figure 7:
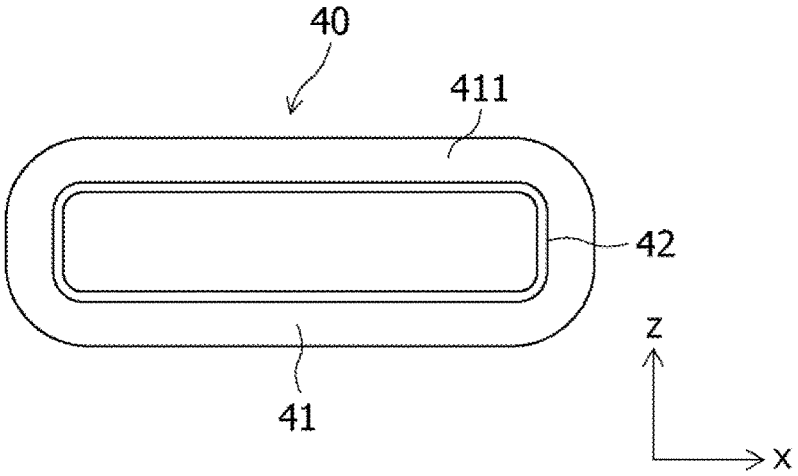
FIG. 7 is a rear view of the rear shell member according to the first embodiment of the present invention.

The main body portion 11 for holding the contacts 20 has, as shown in FIG. 5, a front protruding portion 111 protruding forward, a rear protruding portion 112 protruding rearward, and a lateral protruding portion 113 protruding laterally (in a direction orthogonal to the front and back directions) relative to the front protruding portion 111 and the rear protruding portion 112 between the front protruding portion 111 and the rear protruding portion 112. The lateral protruding portion 113 has a step portion 114.

The rear protruding portion 112 is constituted of a front end portion 112*d* that protrudes rearward from a rear end of the lateral protruding portion 113 and contains no silane coupling agent, a rear end portion 112*a* that is provided at the rear end of the housing 10 and contains no silane coupling agent, and a watertight resin portion 112*c* that is provided between the front end portion 112*d* and the rear end portion 112*a* and contains the silane coupling agent.

The watertight resin portion 112*c* is in close contact with the rear shell member 40 along a circumferential direction of an inner peripheral surface of the rear shell member 40, as well as being in close contact with the contacts 20 along the outer peripheral surfaces of the contacts 20. The watertight resin portion 112*c* is made of a resin of a different type from the resin of the plate-like portion 12, the front protruding portion 111, the rear end portion 112*a*, the front end portion 112*d*, and the lateral protruding portion 113. The resin of the watertight resin portion 112*c* melts at a lower temperature than the resin of the plate-like portion 12, the front protruding portion 111, the rear end portion 112*a*, the front end portion 112*d*, and the lateral protruding portion 113.

Figure 3:
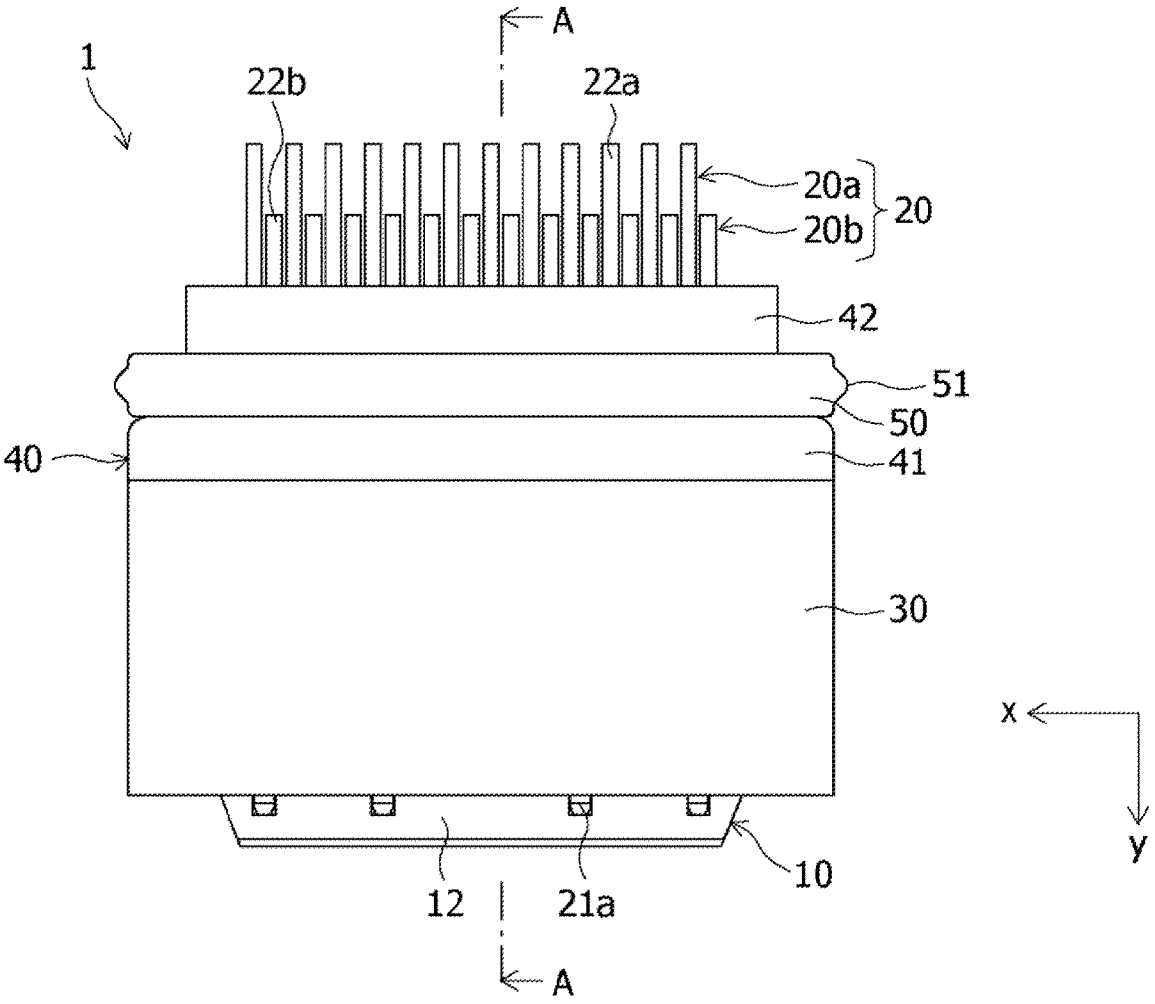
FIG. 3 is a plan view of the electrical connector according to the first embodiment of the present invention.
Figure 4:
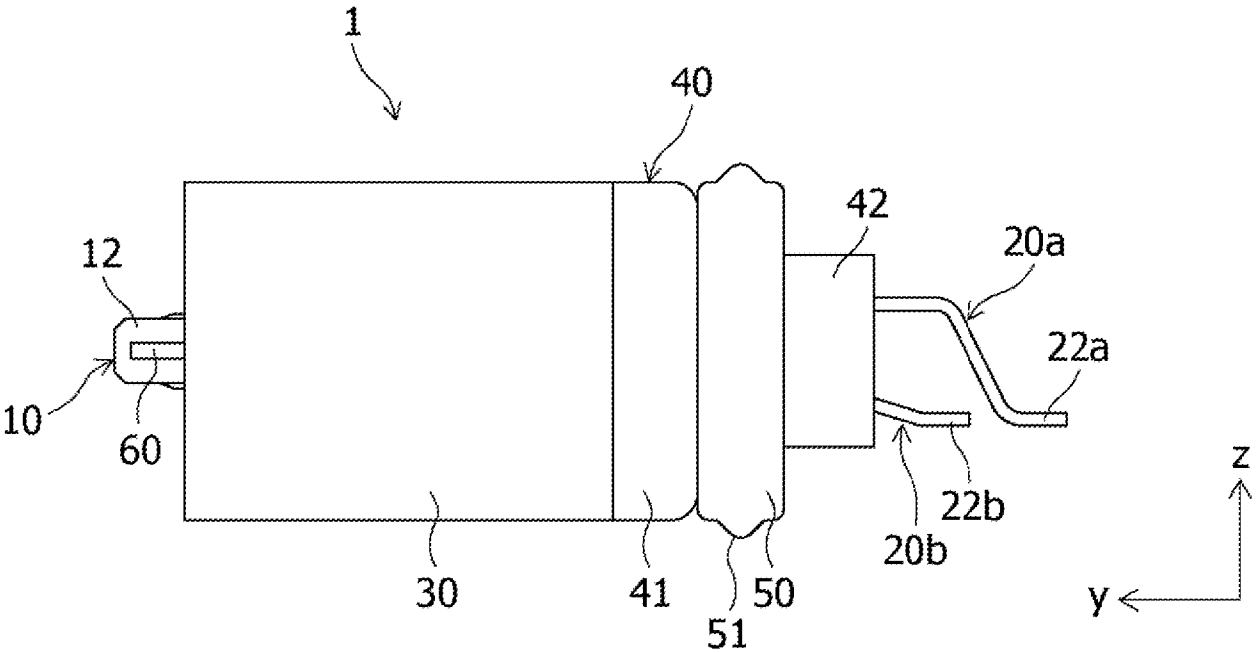
FIG. 4 is a side view of the electrical connector according to the first embodiment of the present invention.

Note that FIG. 3 shows clear boundaries between the front end portion 112*d*, the rear end portion 112*a*, and the watertight resin portion 112*c*, for the sake of explanation, but the boundaries are unclear in fact, because the front end portion 112*d* and the watertight resin portion 112*c* are melted and bonded at their contact portions in a manufacturing process, and the rear end portion 112*a* and the watertight resin portion 112*c* are melted and bonded at their contact portions in the manufacturing process.

The plate-shaped plate-like portion 12 is in the shape of a plate that protrudes forward relative to the main body portion 11, and protrudes forward at its front end relative to the front shell member 30.

The contacts 20 are made of a conductive material, and held by the housing 10. The contacts 20 include first contacts 20*a* and second contacts 20*b* disposed below the first contacts 20*a*. The first contacts 20*a* and the second contacts 20*b* are insulated from each other by the housing 10.

Each first contact 20*a* includes a connection portion 21*a* that is exposed on the front side of the housing 10 on a top surface of the plate-like portion 12 to connect to a mating contact of a not-shown mating connector, and a terminal portion 22*a* that protrudes rearward relative to the housing 10 and is soldered to a conductive portion of a not-shown substrate. The first contact 20*a* is embedded in the front protruding portion 111, the rear protruding portion 112, and the lateral protruding portion 113 at a portion between the connection portion 21*a* and the terminal portion 22*a*. The first contact 20*a* is in close contact with the watertight resin portion 112*c* along its outer peripheral surface. The first contact 20*a* is bent in the left, right, and upward directions in shape at a portion being in close contact with the watertight resin portion 112*c*.

Each second contact 20*b* includes a connection portion 21*b* that is exposed on the front side of the housing 10 on a bottom surface of the plate-like portion 12 to connect to the mating contact of the not-shown mating connector, and a terminal portion 22*b* that protrudes rearward relative to the housing 10 and is soldered to the not-shown substrate. The second contact 20*b* is embedded in the front protruding portion 111, the rear protruding portion 112, and the lateral protruding portion 113 at a portion between the connection portion 21*b* and the terminal portion 22*b*. The second contact 20*b* is in close contact with the watertight resin portion 112*c* along its outer peripheral surface. The second contact 20*b* is bent in the left, right, and downward directions in shape at a portion being in close contact with the watertight resin portion 112*c*. Bottom ends of the terminal portions 22*a* and bottom ends of the terminal portions 22*b* are flush with one another in the vertical direction.

The front shell member 30 is made of a conductive material or an insulating material, and is in the shape of a cylinder penetrating in the front and rear directions. The front shell member 30 has a fitting portion 31 into which the not-shown mating connector can be fitted from the front. The fitting portion 31 is required to have a predetermined inner diameter in conformity with standards and the like to have compatibility. In the fitting portion 31, the plate-like portion 12 and the front protruding portion 111 are disposed. The front shell member 30 is in contact with the step portion 114 at its rear end, and is held on the front side of the lateral protruding portion 113. The front shell member 30 is formed by processing a metal plate, die casting, or metal injection molding (MIM).

The rear shell member 40 is made of a conductive material or an insulating material, and is in the shape of a cylinder penetrating in the front and rear directions. The rear shell member 40 includes a diameter enlarging portion 41 held on the rear side of the lateral protruding portion 113, and a constriction portion 42 that is continuously formed in the rear of the diameter enlarging portion 41 and has a smaller diameter than the diameter enlarging portion 41, so that the rear shell member 40 is narrowed rearward in shape. The outer diameter of the diameter enlarging portion 41 is approximately the same as the outer diameter of the front shell member 30. The front shell member 30 and the diameter enlarging portion 41 constitute a large diameter portion. The diameter enlarging portion 41 has a rear end portion 411, with which a front end portion 53 of the seal member 50 is in contact, at its rear end. The constriction portion 42, i.e., a small diameter portion, is in close contact with the watertight resin portion 112*c* along a circumferential direction of an inner peripheral surface. The rear shell member 40 is formed by processing a metal plate, die casting, or metal injection molding (MIM).

A rear end of the front shell member 30 and a front end of the rear shell member 40 are connected by welding or the like. When the front shell member 30 and the rear shell member 40 are made of conductive materials, the front shell member 30 and the rear shell member 40 have the same electrical potential.

Figure 8:
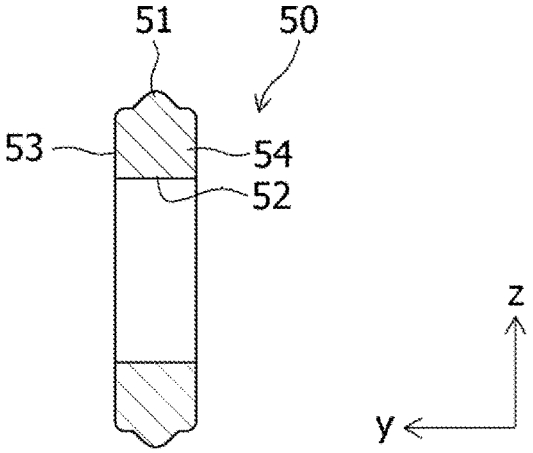
FIG. 8 is a cross-sectional view of a seal member according to the first embodiment of the present invention.

The seal member 50 is in a ring shape, and is provided on an outer periphery of the rear shell member 40. As shown in FIG. 8, the seal member 50 includes a press contact portion 51 that protrudes laterally relative to the front shell member 30 so as to be in press contact with an installation member, an internal wall portion 52 that is in press contact with an outer periphery of the constriction portion 42 of the rear shell member 40, the front end portion 53 that is in press contact with the rear end portion 411 of the diameter enlarging portion 41 of the rear shell member 40, and a proximal end portion 54 as a secured portion that is secured to the constriction portion 42. The internal wall portion 52 is secured to the outer periphery of the constriction portion 42 by bonding or the like using an adhesive, and the front end portion 53 is secured to the rear end portion 411 by bonding or the like using an adhesive.

The seal member 50 has an insulating property or a conductive property, as well as having elasticity. The seal member 50 having an insulating property is made of an elastic material having an insulating property, such as a thermoplastic elastomer or the like. The seal member 50 having a conductive property is made of an elastic material having an insulating property, such as a thermoplastic elastomer, into which metal particles such as silver particles or conductive powder such as carbon black are added and dispersed.

Note that, the seal member 50 is not necessarily secured to the rear shell member 40 by bonding, but may be secured to the rear shell member 40 by press fitting from its rear. The seal member 50 can be secured to the rear shell member 40 by an arbitrary method. A part of the seal member 50, except for the press contact portion 51 of the seal member 50, may protrude laterally relative to the front shell member 30.

The shielding plate 60 is made of a conductive material in a plate shape. The shielding plate 60 is embedded in the housing 10. The shielding plate 60 is provided between the first contacts 20*a* and the second contacts 20*b* so as to be insulated from the first contacts 20*a* and the second contacts 20*b*.

<Method for Installing Electrical Connector in Installation Member>

Figure 9:
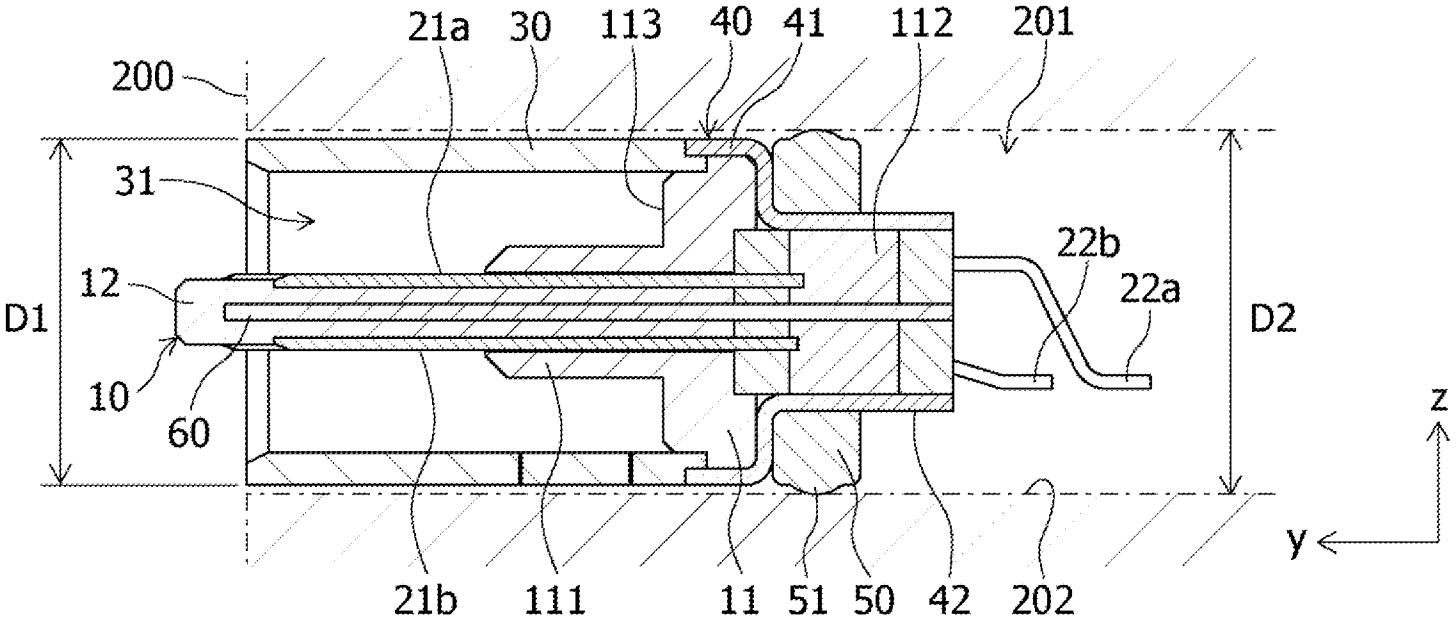
FIG. 9 is a drawing showing a used state of the electrical connector according to the first embodiment of the present invention.

A method for installing the electrical connector 1 according to the first embodiment in the installation member will be described below in detail with reference to FIG. 9.

To insert and install the electrical connector 1 into an installation hole 201 of a casing 200, i.e., an installation member of an electronic device, from its rear to its front, the front shell member 30 is first inserted into the installation hole 201 from its rear, and subsequently the rear shell member 40 is inserted into the installation hole 201 from its rear, so that the press contact portion 51 of the seal member 50 is in press contact with an internal wall 202 of the installation hole 201, and the seal member 50 is elastically deformed inward. At this time, the proximal end portion 54, i.e., a securing portion of the seal member 50 on the constriction portion 42, does not protrude laterally relative to the front shell member 30. Therefore, for example, when the electrical connector 1 is shifted or the like in a direction orthogonal to front and back directions in the middle of inserting the electrical connector 1 into the installation hole 201, the proximal end portion 54, which is a securing portion of the seal member 50 on the constriction portion 42, is prevented from getting snagged on the casing 200, and therefore the seal member 50 can be prevented from being damaged or displaced.

Since the seal member 50 is provided in the constriction portion 42 that has a smaller diameter than the front shell member 30, the inside diameter D2 of the installation hole 201 can be approximately the same in size as the outside diameter D1 of the front shell member 30. When the electrical connector 1 is installed into the installation hole 201, the internal wall 202 can compress the seal member 50 in a distance between the outside diameter of the front shell member 30 and the outside diameter of the constriction portion 42, so that the inside diameter D2 of the installation hole 201 can be set without considering compression limitations of the seal member 50. Therefore, the inside diameter D2 of the installation hole 201 can be reduced, thus allowing a reduction in the size of the casing 200 of the electronic device.

When the electrical connector 1 is installed into the installation hole 201, the internal wall 202 can compress the seal member 50 in the distance between the outside diameter of the front shell member 30 and the outside diameter of the constriction portion 42. Therefore, when a press contact force of the seal member 50 against the internal wall 202 is set at a predetermined value, the seal member 50 can be set in such dimensions as to reduce a compression ratio of the seal member 50 without enlarging the inside diameter D2 of the installation hole 201, as compared with before. Therefore, it is possible, as well as to reduce the size and thickness of the electrical connector 1, to give the seal member 50 a longer life by a reduction in a compression load applied from the internal wall 202 to the seal member 50.

Furthermore, when the electrical connector 1 is installed into the installation hole 201, the internal wall 202 can compress the seal member 50 in the distance between the outside diameter of the front shell member 30 and the outside diameter of the constriction portion 42. Therefore, the thickness of a compression portion of the seal member 50 can be increased, and thus a press contact capable area can be enlarged in an appropriate compressibility of the seal member 50 against the internal wall 202, and thereby the dimensions of the internal wall 202 are not required to be managed with high accuracy, thus allowing an increase in productivity.

As described above, according to this embodiment, the elastically deformable seal member 50 is provided on the outer periphery of the constriction portion 42 of the cylindrical shell, which includes the front shell member 30 having the fitting portion 31 open forward into which a mating connector is insertable, the diameter enlarging portion 41, and the constriction portion 42 provided behind the front shell member 30 and the diameter enlarging portion 41. From the constriction portion 42, the terminal portions 22*a* and 22*b* protrude. The constriction portion 42 has a smaller diameter than the front shell member 30 and the diameter enlarging portion 41. Accordingly, the casing 200 is prevented from getting snagged on the proximal end portion 54 of the seal member 50 provided on the rear shell member 40, thus allowing downsizing and slimming of the electrical connector 1, as well as an improvement in productivity.

According to this embodiment, since the seal member 50 includes the press contact portion 51 that protrudes laterally relative to the front shell member 30 and the diameter enlarging portion 41, to be in press contact with the installation member, the seal member 50 can be reliably in press contact with the installation member.

According to this embodiment, since the seal member 50 is in contact with the rear end portion 411 of the diameter enlarging portion 41, the seal member 50 can be easily positioned with respect to the rear shell member 40.

According to this embodiment, since the internal wall portion 52 of the seal member 50 is secured to the constriction portion 42 by bonding or the like, and the front end portion 53 of the seal member 50 is secured to the rear end portion 411 of the diameter enlarging portion 41 by bonding or the like, the seal member 50 can be secured to the rear shell member 40 at an increased securing area. The seal member 50 can be firmly secured to the rear shell member 40, and thus prevented from dropping off.

According to this embodiment, the provision of the seal member 50 on the outer periphery of the rear shell member 40 can eliminate the need for providing a casing for the seal member 50, thus allowing downsizing and slimming of the electrical connector 1.

According to this embodiment, when the front shell member 30 and the rear shell member 40 are made of conductive materials, since the front shell member 30 and the rear shell member 40 cover the outer periphery of the housing 10, it is possible to reduce noise from outside and improve electrical performance of the electrical connector 1.

According to this embodiment, when the front shell member 30 and the rear shell member 40 are made of conductive materials, since the front shell member 30 and the rear shell member 40 have the same electrical potential, it is possible to keep the impedance of the contact 20 of the electrical connector 1 constant, thus contributing to an improvement in electrical performance.

According to this embodiment, in a case where both of the seal member 50 and the installation member have conductive properties, when the electrical connector 1 is installed in the installation member, the front shell member 30, the rear shell member 40, the seal member 50, and the installation member are electrically connected. Therefore, when the installation member is a metal casing or the like of the electronic device, the electrical connector 1 can contribute to an improvement in shielding performance of the electronic device or measures against static electricity thereof.

According to this embodiment, since the watertight resin portion 112*c* containing a silane coupling agent is in close contact with the inner peripheral surface of the rear shell member 40 so as to seal a gap between the watertight resin portion 112*c* and the rear shell member 40, the interior of the electronic device in which the electrical connector 1 is installed can be tightly sealed from a gap between the housing 10 and the rear shell member 40, and can be made watertight. In the electrical connector 1, since the watertight resin portion 112*c* containing the silane coupling agent is in close contact with the outer peripheral surfaces of the contacts 20 so as to seal gaps each between the watertight resin portion 112*c* and each contact 20, the interior of the electronic device in which the electrical connector 1 is installed can be tightly sealed from gaps each between the housing 10 and each contact 20 and can be made watertight. Furthermore, since the electrical connector 1 can acquire a watertight function only by providing the watertight resin portion 112*c* between the contacts 20 and the constriction portion 42, the rear side of the electrical connector 1 can be reduced in size.

Second Embodiment

<Configuration of Electrical Connector>

The configuration of an electrical connector 2 according to a second embodiment of the present invention will be described below in detail with reference to FIG. 10.

Figure 10:
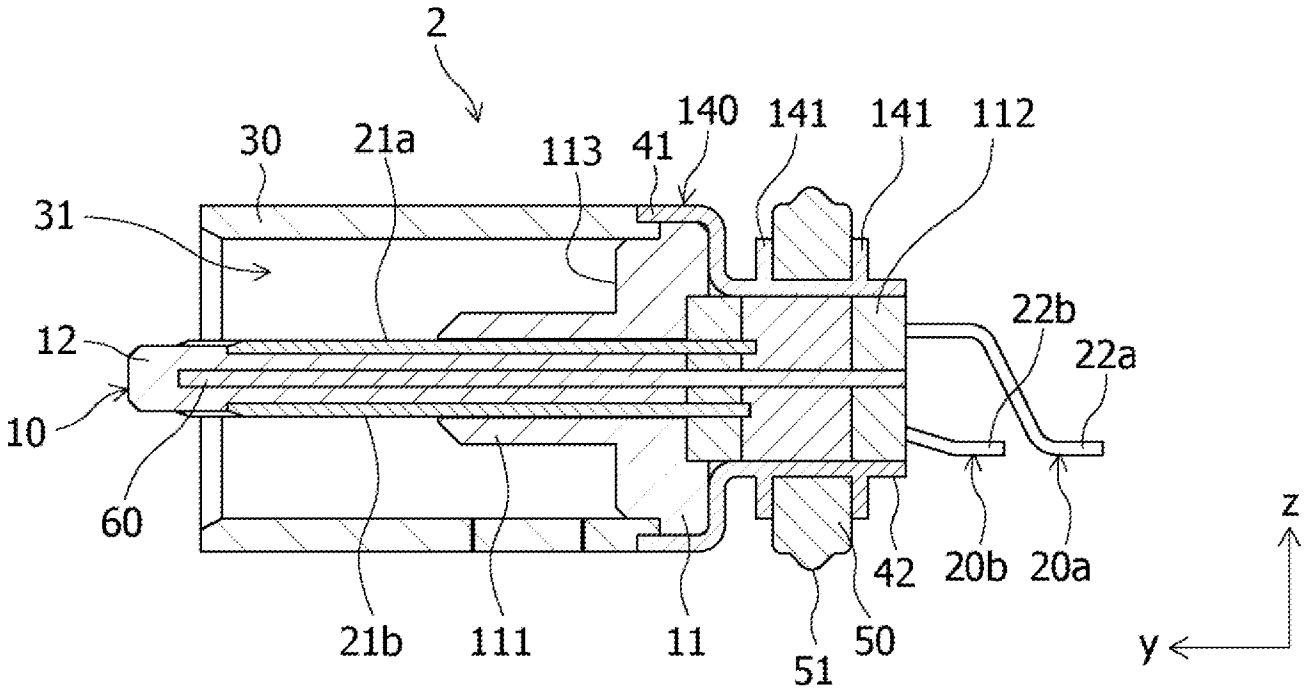
FIG. 10 is a cross-sectional view of an electrical connector according to a second embodiment of the present invention.

Note that, in FIG. 10, the same reference numerals as in FIGS. 1 to 8 indicate the same components, and a description thereof will be omitted.

The electrical connector 2 according to this embodiment includes a housing 10, contacts 20, a front shell member 30, a seal member 50, a shielding plate 60, and a rear shell member 140.

The rear shell member 140 is made of a conductive material or an insulating material, and is in the shape of a cylinder penetrating in the front and rear directions. A pair of ribs 141 are provided on an outer periphery of a constriction portion 42 of the rear shell member 140. The ribs 141 protrude laterally less than the front shell member 30. A distance between the pair of ribs 141 in the front and rear directions is the same as or slightly larger than the length of the seal member 50 in the front and rear directions in a state of being attached to the rear shell member 140. Note that, the other structure of the rear shell member 140, except for the above, is the same as that of the rear shell member 40, so that a description thereof is omitted.

When the front shell member 30 and the rear shell member 140 are made of conductive materials, the front shell member 30 and the rear shell member 140 have the same electrical potential.

The seal member 50 is attached to the rear shell member 140 in such a manner as to be contained in the pair of ribs 141.

A method for installing the electrical connector 2 according to this embodiment is the same as the method for installing the electrical connector 1, so that a description thereof is omitted.

As described above, according to this embodiment, the elastically deformable seal member 50 is provided on the outer periphery of the constriction portion 42 of the cylindrical shell, which includes the front shell member 30 having the fitting portion 31 open forward into which a mating connector is insertable, the diameter enlarging portion 41, and the constriction portion 42 provided behind the front shell member 30 and the diameter enlarging portion 41. From the constriction portion 42, the terminal portions 22*a* and 22*b* protrude. The constriction portion 42 has a smaller diameter than the front shell member 30 and the diameter enlarging portion 41. Accordingly, the casing 200 is prevented from getting snagged on the proximal end portion 54 of the seal member 50 provided on the rear shell member 140, thus allowing downsizing and slimming of the electrical connector 2, as well as an improvement in productivity.

According to this embodiment, since the seal member 50 includes the press contact portion 51 that protrudes laterally relative to the front shell member 30 and the diameter enlarging portion 41, to be in press contact with the installation member, the seal member 50 can be reliably in press contact with the installation member.

According to this embodiment, the provision of the seal member 50 on the outer periphery of the rear shell member 40 can eliminate the need for providing a casing for the seal member 50, thus allowing downsizing and slimming of the electrical connector 2.

According to this embodiment, when the front shell member 30 and the rear shell member 140 are made of conductive materials, since the front shell member 30 and the rear shell member 140 cover the outer periphery of the housing 10, it is possible to reduce noise from outside and improve electrical performance of the electrical connector 2.

According to this embodiment, when the front shell member 30 and the rear shell member 140 are made of conductive materials, since the front shell member 30 and the rear shell member 140 have the same electrical potential, it is possible to keep the impedance of the contact 20 of the electrical connector 2 constant, thus contributing to an improvement in electrical performance.

According to this embodiment, in a case where both of the seal member 50 and the installation member have conductive properties, when the electrical connector 2 is installed in the installation member, the front shell member 30, the rear shell member 140, the seal member 50, and the installation member are electrically connected. Therefore, when the installation member is a metal casing or the like of the electronic device, the electrical connector 2 can contribute to an improvement in shielding performance of the electronic device or measures against static electricity thereof.

According to this embodiment, since the watertight resin portion 112*c* containing a silane coupling agent is in close contact with the inner peripheral surface of the rear shell member 140 so as to seal a gap between the watertight resin portion 112*c* and the rear shell member 140, the interior of the electronic device in which the electrical connector 2 is installed can be tightly sealed from a gap between the housing 10 and the rear shell member 140, and can be made watertight. In the electrical connector 2, since the watertight resin portion 112*c* containing the silane coupling agent is in close contact with the outer peripheral surfaces of the contacts 20 so as to seal gaps each between the watertight resin portion 112*c* and each contact 20, the interior of the electronic device in which the electrical connector 2 is installed can be tightly sealed from gaps each between the housing 10 and each contact 20 and can be made watertight. Furthermore, since the electrical connector 2 can acquire a watertight function only by providing the watertight resin portion 112*c* between the contacts 20 and the constriction portion 42, the rear side of the electrical connector 2 can be reduced in size.

According to this embodiment, since the seal member 50 is positioned using the ribs 141 provided on the rear shell member 140, the seal member 50 can be disposed in a desired position with respect to the rear shell member 140.

The pair of ribs 141 are provided in this embodiment, but a single rib may be provided on the constriction portion 42, and the seal member 50 may be contained between the rib and a rear end portion 411 of a diameter enlarging portion 41.

The ribs 141 are integral with the constriction portion 42 in this embodiment, but a separate member from the rear shell member 40 may be provided in the rear shell member 40, and the separate member may have a portion to position the seal member 50.

The present invention is not limited to the foregoing embodiments in terms of the types, arrangement, numbers, or the like of the members. It will be understood that appropriate modifications may be made without departing from the gist of the invention. For example, the components may be replaced with ones having similar operations and effects as appropriate.

To be more specific, in the above-described first and second embodiments, the two members, i.e., the front shell member 30 and the rear shell member 40 or the rear shell member 140, constitute one shell, but the shell may be constituted of a single member.

In the first and second embodiments, the rear shell member 40 includes the diameter enlarging portion 41 and the constriction portion 42, but a constriction portion may be provided at the rear of a front shell member, and an entire rear shell member may have the same diameter as the constriction portion. In this case, a front side of the front shell member has a large diameter, while the constriction portion of the front shell member, and the rear shell member have a small diameter.

In the first and second embodiments, the housing may have an arbitrary shape, as long as the housing can be contained in the front shell member 30 and the rear shell member 40.

The embodiments of the present invention are suitably applied to electrical connectors having a watertight function.

REFERENCE SIGNS LIST

1 electrical connector
2 electrical connector
10 housing
11 main body portion
12 plate-like portion
20 contact
20*a* first contact
20*b* second contact
21*a* connection portion
21*b* connection portion
22*a* terminal portion
22*b* terminal portion
30 front shell member
31 fitting portion
40 rear shell member
41 diameter enlarging portion
42 constriction portion
50 seal member
51 press contact portion
52 internal wall portion
53 front end portion
54 proximal end portion
60 shielding plate
111 front protruding portion
112 rear protruding portion
112*a* rear end portion
112*c* watertight resin portion
112*d* front end portion
113 lateral protruding portion

114 step portion
140 rear shell member
141 rib
200 casing
201 installation hole
202 internal wall
411 rear end portion

The invention claimed is:

1. An electrical connector comprising:

a holding member having an insulation property;

a contact having a conductive property, the contact being held by the holding member, the contact including a connection portion exposed on a front side of the holding member to be connected to a mating contact of a mating connector and a terminal portion protruding from the holding member;

a shell configured to be cylindrical and contain the holding member, the shell including a large diameter portion and a small diameter portion, the large diameter portion having a fitting portion open forward into which the mating connector is insertable, the small diameter portion being provided at the rear of the large diameter portion so as to protrude the terminal portion therefrom, the small diameter portion having a smaller diameter than the large diameter portion; and a seal member configured to be elastically deformable and be provided on an outer periphery of the small diameter portion, wherein the shell comprises a front shell member having at least the large diameter portion, and a rear shell member having at least the small diameter portion, the rear shell member being formed as a separate member from the front shell member, and the front shell member and the rear shell member are electrically connected to each other.

2. The electrical connector according to claim 1, wherein the seal member includes a press contact portion configured to protrude laterally relative to the large diameter portion so as to be in press contact with an installation member.

3. The electrical connector according to claim 1, wherein the seal member is in contact with a rear end of the large diameter portion.

4. An electrical connector comprising:

a holding member having an insulation property;

a contact having a conductive property, the contact being held by the holding member, the contact including a connection portion exposed on a front side of the holding member to be connected to a mating contact of a mating connector and a terminal portion protruding from the holding member;

a shell configured to be cylindrical and contain the holding member, the shell including a large diameter portion and a small diameter portion, the large diameter portion having a fitting portion open forward into which the mating connector is insertable, the small diameter portion being provided at the rear of the large diameter portion so as to protrude the terminal portion therefrom, the small diameter portion having a smaller diameter than the large diameter portion; and a seal member configured to be elastically deformable and be provided on an outer periphery of the small diameter portion, wherein the seal member has a conductive property.

5. The electrical connector according to claim 4, wherein the seal member includes a press contact portion configured to protrude laterally relative to the large diameter portion so as to be in press contact with an installation member.

6. The electrical connector according to claim 4, wherein the seal member is in contact with a rear end of the large diameter portion.

* * * * *